United States Patent [19]

Thornton

[11] 3,988,835

[45] Nov. 2, 1976

[54] MARKING DEVICE

[76] Inventor: William Franklin Thornton, 351 Hudson Ave., McDonald, Pa. 15057

[22] Filed: Dec. 16, 1974

[21] Appl. No.: 532,902

Related U.S. Application Data

[63] Continuation-in-part of Ser. No. 374,692, June 28, 1973.

[52] U.S. Cl. ..... 33/36; 101/329

[51] Int. Cl.[2] ..... B25H 7/00

[58] Field of Search ..... 33/36, 38, 41 C, 42, 33/141 R; 16/18 CG, 41; 101/116, 118, 216, 328–331

[56] References Cited

UNITED STATES PATENTS

| | | | |
|---|---|---|---|
| 973,534 | 10/1910 | Meyerheim | 33/41 C |
| 2,451,595 | 10/1948 | Wheeler | 33/36 |
| 2,498,980 | 2/1950 | Bowling et al. | 101/328 |
| 3,046,884 | 7/1962 | Pearson | 33/36 |
| 3,546,779 | 12/1970 | Klein | 33/36 |

*Primary Examiner*—Richard E. Aegerter
*Assistant Examiner*—L. Footland
*Attorney, Agent, or Firm*—Fred C. Trenor

[57] ABSTRACT

A marking device has a cylindrical housing journalled to an extended arm. The cylindrical housing has an outer peripheral surface whose circumference preferably corresponds to a standard linear distance that is normally encountered in the building industry. The peripheral surface has at least one marking element extending radially from it so that as the cylindrical housing is rotated over a workpiece, the marking element leaves a mark on the workpiece that serves as a centerline measurement for the accurate alignment and placement of building components on the workpiece. The extended arm of the device includes a movable guide that may be extended radially beyond the peripheral surface of the cylindrical housing for guiding the marking device as it is moved along the workpiece or that may be retracted radially from its extension beyond the peripheral surface so that the marking device may be used on an extended planar surface without the guide interfering with the travel of the device over the planar surface.

8 Claims, 13 Drawing Figures

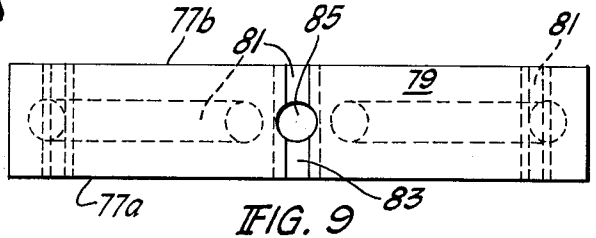
FIG. 9
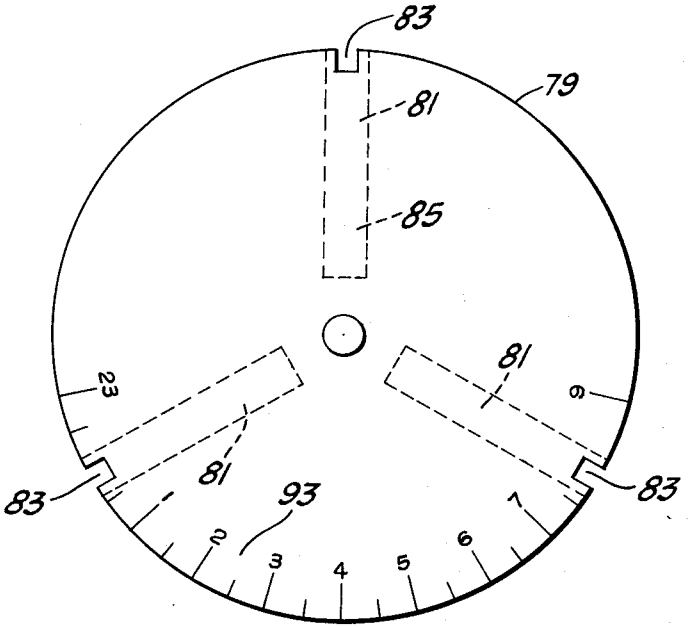
FIG. 8
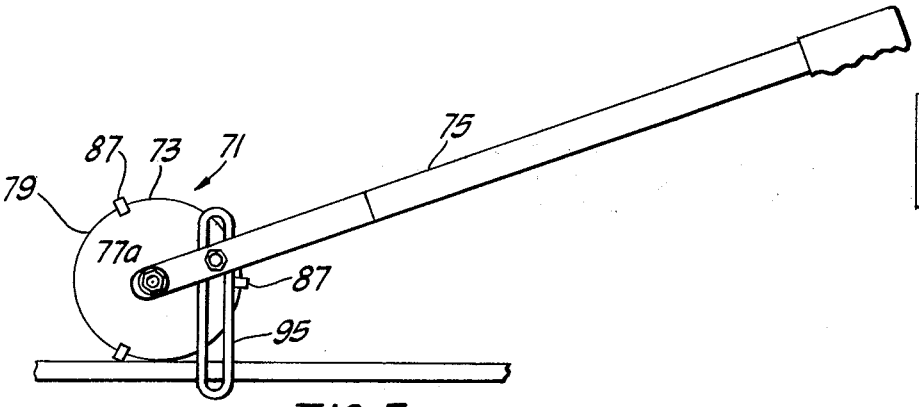
FIG. 7
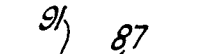
FIG. 11
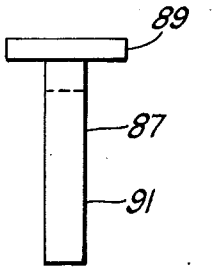
FIG. 12
FIG. 10

MARKING DEVICE

CROSS-REFERENCE TO RELATED APPLICATIONS

This application is a continuation-in-part of my copending application, Ser. No. 374,692 filed June 28, 1973, entitled "A Marking Device."

BACKGROUND OF THE INVENTION

1. The Field of the Invention

This invention relates to a marking device for use in the housing industry. The marking device of this invention is used to mark various building components such as, for example, baseboards, sill plates, roof decks, floor decks and the like so that they may be quickly and accurately positioned and secured at standarized spaced intervals to other building components such as, for example, studs, joists, rafters, trusses and the like.

Heretofore, the marking of building components has been done manually by a carpenter or his helper with a ruler and a pencil. For example, in erecting a wall, it has been necessary for a carpenter to locate with a ruler and mark on the base plate the centerline for each stud or joist. (Usually each stud is spaced at 16 inch intervals from each other.) This function is tedious and time consuming. Further, it has been necessary for the carpenter or his helper to climb upon the wall after its erection and to locate and mark the centerline for trusses and the like that are later mounted and secured to the top plate of the wall. This function is likewise tedious and time consuming and, moreover, it is dangerous as the carpenter or his helper can easily fall from his precarious perch on top of the wall.

In covering a roof with shingles or the like, it has been necessary for a carpenter or his helper to locate with a ruler and mark the rows at which shingles for covering the roof are to be aligned. (Usually each row of shingles is spaced at four-inch intervals from the preceding row of shingles.) Again, this function is tedious and time consuming.

In securing plywood sheeting to joists or the like to provide a roof or floor, a carpenter or his helper have found it difficult to locate unseen joists or studs beneath the sheeting and, frequently, the nails miss the underlying joists or studs.

Consequently, the plywood sheeting is not properly and adequately nailed to the underlying joists. In floors, this failure to properly secure the sheeting to the underlying joists can cause the floor to squeak under normal foot traffic.

Accordingly, there has been a long-felt need for a versatile marking device that can be used easily and quickly to mark spaced intervals on a variety of selected workpieces.

2. Description of the Prior Art

U.S. Pat. No. 3,546,779 (Klein) describes and illustrates a marking device of limited utility in the building industry for marking building components such as 2 × 4's at standardized intervals. The marking device of Klein comprises a wheel having four marking pens inserted inside it that project from the peripheral surface of the wheel. As the wheel rotates over a workpiece, the marking pens impart four tiny dots on the workpiece; the appropriate building components are spaced between the four tiny dots. The wheel of the Klein device is journalled to a bifurcated handle having legs extending beyond the periphery of the wheel and straddling the workpiece to be marked. The Klein device has several limitations. For example, it can be used only on workpieces that can be straddled by the bifurcated legs of the handle. If the width of the wheel or the distance between the legs is greater than the width of the workpiece, the guides will not engage the edge of the workpiece and, accordingly, the device will mark the workpiece erratically and not in a straight line. Or, if the width of the wheel or the distance between the legs is less than the width of the workpiece, the device cannot be conveniently used at all.

The four dots made by the Klein device may be easily obscured as contrasted to a solid line extending across the width of the workpiece to be marked. The Klein device cannot be used on a flat or extended planar surface such as, for example, a roof or a floor deck because the guides extend beyond the periphery of the wheel and would interfere with its travel.

Another marking device of limited utility in the building industry is illustrated in U.S. Pat. No. 2,451,595 (Wheeler). The marking device of Wheeler comprises a wheel having at least two projecting marking elements extending substantially across the entire width of the wheel on its peripheral surface which impart two spaced lines on the workpiece to be marked. The appropriate building component is positioned between the two marks. The marking wheel further has a flange to one edge of the wheel to be used as a guide. The wheel is journalled to an extended arm. The Wheeler device has several limitations. For example, the Wheeler device is restricted for use with building components having fixed dimensions (apparently, a two-inch width) as the marking element impart two lines between which the building components are to be placed. If the distance between the marks is normally two inches, then the marking device cannot be used with a building component having a width greater or less than two inches. A further limitation of the Wheeler device is its inability to be used on an extended planar surface such as a roof since the flange extending beyond the peripheral surface of the wheel is fixed thereto and would interfere with its travel.

Accordingly, I have developed a marking device that does not have the limitations of the devices of Wheeler and Klein and which has a greater versatility in the building industry as will appear more fully in the description of my invention. Moreover, my marking device is of greater simplicity and, quite surprisingly, of greater utility than the devices of the prior art.

SUMMARY OF THE INVENTION

In accordance with my invention, a marking device comprises a wheel having spaced apart faces and an outer peripheral surface of a predetermined circumference that corresponds to a standard linear distance in the building industry. There is at least one slot formed in the peripheral surface of the wheel that is substantially perpendicular to the faces of the wheel. The slot extends across the peripheral surface from its one edge to within about one-quarter of an inch of its other edge. A marking element extends into the interior of the wheel and protrudes through the slot and is substantially coextensive with the cross-sectional area of the slot. The wheel contains an ink supply source within its interior for supplying ink to the marking element. The wheel is journalled to the end of a handle or extended arm. The extended arm has a movable guide fixed to it so that this movable guide may extend radially beyond the peripheral surface of the wheel for guiding the marking device alongside the edge of a selected workpiece to be marked or so that the movable guide may be retracted radially from its extension beyond the peripheral surface of the wheel so that the marking device may be used on a planar surface without interference.

BRIEF DESCRIPTION OF THE DRAWINGS

In the drawings:

FIG. 7 illustrates a side elevational view of another embodiment of this invention;

FIG. 8 illustrates an isolated side elevational view of the marking wheel of FIG. 7;

FIG. 9 illustrates a plan view of the isolated marking wheel of FIG. 8;

FIG. 10 illustrates an isolated front elevation view of the marking element in the marking wheel of FIG. 7;

FIG. 11 illustrates a plan view of the marking element of FIG. 10; and

FIG. 12 illustrates side elevation view of the marking element of FIG. 10.

DETAILED DESCRIPTION

Figure 1:
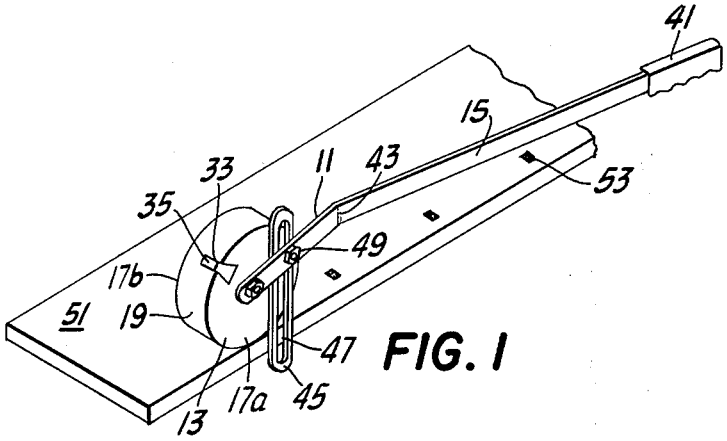
FIG. 1 illustrates an isometric view of the marking device of my invention with the movable guide in its extended position.

In FIG. 1, the marking device is generally indicated at 11 and includes a marking wheel 13 that is journalled to an extended arm 15.

The marking wheel or cylindrical housing 13 has two faces substantially parallel 17 (*a*) and 17 (*b*), and a peripheral surface 19. The peripheral surface 19 has a predetermined circumference that corresponds to a standard linear distance normally encountered in the building industry such as, for example, 16 inch or 24 inch centerline intervals. If the marking wheel is to be used to mark 16 inch centerline intervals for the placement of studs in a wall then the circumference of the peripheral surface will be 16 inches.

Figure 3:
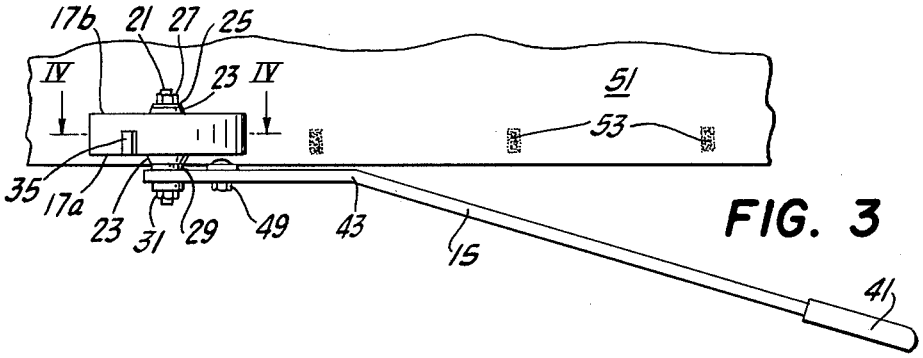
FIG. 3 illustrates a top planar view of the device of FIG. 1.

The marking wheel 13 is journalled on axle 21 as illustrated more clearly in FIG. 3. The marking wheel 13 has two bosses 23 on each face 17 (*a*) and 17 (*b*) that extend axially outwardly from the faces of the marking wheel so that there is clearance between the wheel and the extended arm 15 as illustrated in FIG. 3. Alternatively, a sleeve (not shown) in lieu of the bosses may be inserted between the wheel and the arm to provide the required clearance. On one side of the wheel opposite the arm 15 at face 17 (*b*) there is a washer 25 and nut 27 and, on the other side at face 17 (*a*), there is a washer 29 and an extended arm 15 that is appropriately secured with a nut 31 to the axle. For optimum performance of my marking device of the invention there should be a minimum amount of play between the marking wheel 13 and its axle 21 so as to provide a true and accurate marking capability. It will be readily recognized to one skilled in the art, however, that the means by which the marking wheel 13 is journalled to the extended arm is not critical to the invention so long as the wheel may conveniently be removed from the axle and replaced with a different sized wheel.

Figure 2:
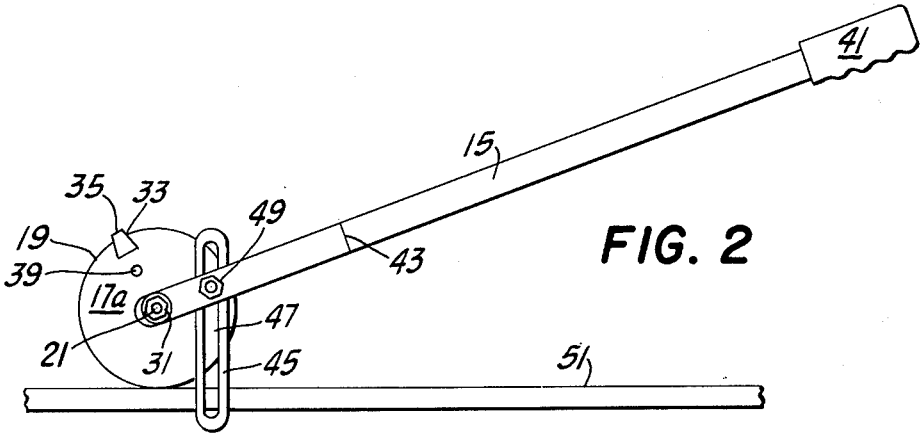
FIG. 2 illustrates a side elevational view of the device of FIG. 1.
Figure 4:
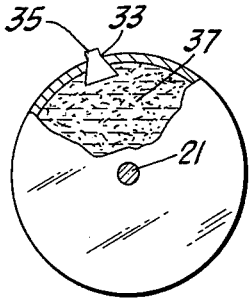
FIG. 4 illustrates a sectional view taken at lines IV—IV of FIG. 3.

As illustrated in FIGS. 2–4 the marking wheel 13 has a slot 33 that extends across the peripheral surface 19 of the wheel beginning at one face 17 (*a*) of the wheel and extending to within about one-quarter of one inch of the other face 17 (*b*) of the wheel. A marking element 35 extends into the interior of the wheel and protrudes radially through the slot 33 but not axially and is substantially coextensive with the cross-sectional area of the slot as viewed in FIGS. 2–4.

The cross-sectional configuration of slot 33 as viewed in FIGS. 2 and 4 is generally trapezoidal (forming a first aperture) with the wider or broader base thereof being disposed inwardly of the wheel and as viewed in FIG. 3 is substantially rectangular (forming a second aperture) so that the marking element is firmly secured in the slot. The marking element 35 forms a solid trapezoid having a trapezoidal cross-sectional configuration that subsequently fills the trapezoidal cross-sectional configuration on the face of the wheel yet protrudes through the slot formed on the peripheral surface of the wheel. If it is desired to remove the marking element 35 from the wheel for replacement or the like, it may be removed axially from the wheel, however, it cannot be moved radially from the wheel. Hence, the marking element is locked into position.

The marking element 35 is preferrably composed of a firm but absorbent material such as, for example, felt that can absorb and retain fluid ink, yet that can withstand the impact pressures to which the marking element is constantly subjected without its damage or injury.

The marking wheel illustrated in FIG. 4 contains in its interior an ink supply source 37 for supplying ink to the marking element 35. Preferably, the ink supply source contains an absorbent material such as, for example, cotton fibers or the like that absorb and hold the fluid ink. A port 39 is provided in the face 17 (*b*) of the wheel for periodically supplying fluid ink to the ink supply source.

As contemplated in FIGS. 1–4 the marking element 35 and the ink supply source 37 are separate members; however, they could comprise a single unit if desired.

The extended arm 15 at its other end has a rubber handle 41. As illustrated in FIG. 3, the extended arm 15 is canted from the line of travel of the marking wheel 13. This is a desirable feature of my invention in that the user of my device by grasping the handle 41 will not interfere with the line of travel of my device as it is being used in situations where there is a likelihood of interference in the travel such as, for example, when the user is placing marks on the floor adjacent a vertical wall.

Intermediate the end of the extended arm 15 to which the marking wheel is fixed and the point at which the extended arm is canted 43, a movable guide 45 is secured. The movable guide 45 includes an elongated slot 47 and the guide is fixed to the arm with appropriate bolt and nut arrangement at 49. The elongated slot provides a desirable feature to my invention as the movable guide may be adjusted with respect to the extended arm to provide the desired amount of extension and provides the device with a great deal more versatility than prior art devices. This elongated slot in the guide also permits the guide to be adjusted at varying angles between the extended arm.

Figure 5:
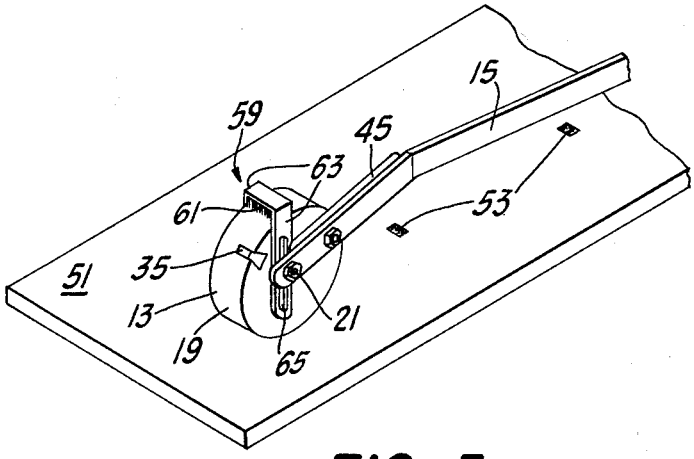
FIG. 5 illustrates an isometric view of the marking device of this invention with the movable guide in its retracted position.

As illustrated in FIG. 1, the movable guide 45 is extended downwardly so as to engage the edge of the workpiece 51 illustrated therein. As the marking wheel is guided along the edge of the workpiece 51, incremental marks 53 are imparted upon the workpiece. Accordingly, the guide 45 permits the marking wheel to be guided accurately along the workpiece. In FIG. 5, the guide is retracted from its extended position beyond the peripheral surface 19 of the marking wheel and, thus, may be used on the extended planar surface illustrated in FIG. 5 to impart marks 53 on the workpiece therein illustrated. The fact that the guide is movable renders the device more versatile that prior art devices in that it may be used to mark studs or base plates with the guide in the extended position or, on the other hand, it may be used to mark sheets of plywood in the center away from their edge as illustrated in FIG. 5 with the guide in its retracted position without interfering with the travel of the wheel.

Figure 6A:
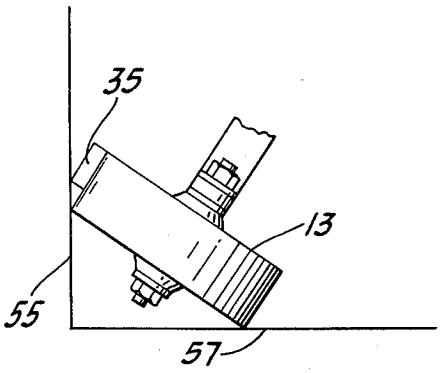
FIG. 6 (*a*) and 6 (*b*) illustrate a front elevational view of the marking device of this invention being used to mark a vertical member such as a wall.
Figure 6B:
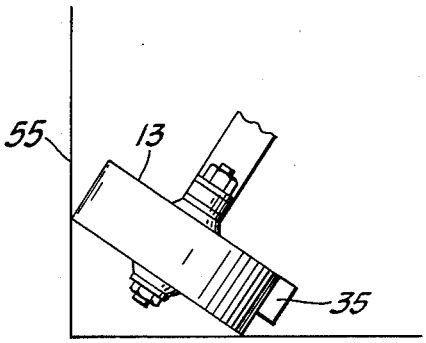

In FIGS. 6 (*a*) and 6 (*b*), the marking device of my invention is illustrated as being used to mark a vertical wall 55 without marking the horizontal wall 57 or floor. This capability is desirable in those instances where it is necessary to periodically mark a vertical wall 55 for placement of a baseboard but not the floor 57; for example, when a fabric carpet has previously been installed on the floor. In this situation, the marking wheel 13 must be elevated at greater than a 45° angle to the vertical wall. With the marking element 35 being offset, the marking element will impart a mark upon the vertical wall but not a mark on the horizontal floor.

An additional feature of my invention is an attachment brush, generally indicated at 59, that is removably fixed to the axle 21 as illustrated in FIG. 5. The attachment brush 59 comprises a brush 61 whose bristles engage the peripheral surface 19 of the wheel to clear it of debris and dust particles. Extended from the brush 61 on each side are legs 63 that straddle the marking wheel and that are secured to the axle 21 as shown in FIG. 5. Each leg includes a slot 65 so that the position of the brush 61 with respect to the peripheral surface 19 of the wheel may be adjusted to accomodate different sized wheels. The attachment brush is a desirable feature of my invention in that it clears the peripheral surface as well as the marking element 35 of debris and dust particles so that the marking element's ability to impart a mark on the workpiece is not obscured.

Another desirable feature of my invention is the indexing of the wheel with numerals that are placed at spaced intervals (usually equal to one inch intervals) on the face of the wheel near the peripheral surface (not shown in the drawings). If the wheel has a circumference of 16 inches, for example, then the wheel is indexed from the numeral one to the numeral sixteen at one inch intervals. The desirable feature of the index is that it is used to accurately align the marking element of the device with the appropriate starting point of the workpiece to be marked. For example, assuming the use of a wheel having a 24 inch circumference to mark the workpiece at 24 inch intervals, if the first centerline mark is to be made at a distance of 10 inches from the starting point on the workpiece, the wheel will be aligned with the numeral fourteen at the starting point so that when the wheel is rotated forwardly the first mark is made 10 inches from the starting point.

In FIGS. 7 through 12 another embodiment of the invention is illustrated. In FIG. 7 the marking device, generally indicated at 71, includes a marking wheel 73 that is journalled to an extended arm 75 in a similar fashion as the wheel illustrated in FIGS. 1–3. The marking wheel of 73 has two substantially parallel faces 77 (*a*) and 77 (*b*) and a peripheral surface 79. The peripheral surface 79 has a predetermined circumference that corresponds to a standard linear distance normally encountered in the building industry. Preferably its cicumference is equivalent to 24 inches.

The marking wheel of 73 in FIGS. 7–9 contains at least three marking element recesses 81. Each such recess 81 comprises a slot 83 that extends across the peripheral surface 79 of the wheel 73 beginning at one face 77 (*a*) and extending to the other face 77 (*b*). The slot 79 is essentially perpendicular to the faces 77 (*a*) and 77 (*b*). Extending from the slot 83 radially inwardly is an aperture 85 as illustrated in FIG. 8. The slot 83 and radially extending inwardly aperture 85 together comprise the recess 79 for retaining the marking element 87 more clearly illustrated in FIGS. 10–12.

As illustrated in FIG. 9 the slot 83 is essentially rectangular in its cross-sectional configuration and the aperture 85 is essentially circular in its cross-sectional configuration having a diameter greater than the width of the rectangular cross-sectional configuration of slot 83. While these particular cross-sectional configurations are preferred it will be recognized by those skilled in the art that the width of the rectangular cross-sectional configuration of the slot 83 could be greater than the diameter of the aperture 85.

As illustrated in FIG. 8 there are at least three marking element recesses 81 each of which has a similar cross-sectional configuration as previously described. Each recess is disposed at 120° angles from each other. In the preferred embodiment of this invention in which the circumference of the peripheral surface 79 is 24 inches, the distance from one recess to the adjacent recess is 8 inches. This feature is particularly desirable in that the marking device has the versatility to mark at 8 inch, 16 inch, and/or 24 inch intervals.

The marking element recess 81 has dimension such that it may receive the marking element 87 illustrated in FIGS. 10–12. The marking element in FIGS. 10–12 comprises two portions, an essentially rectangular portion 89 and an essentially columnar member 91 both of which preferably comprise a single unit; however, they may comprise separate portions if desired. The essentially rectangular member 89 is composed of a material that is firm but absorbent such as, for example, felt that can adsorb and retain fluid ink, yet that can withstand the impact pressures to which the marking element is constantly subjected without damage or injury. As illustrated in FIG. 8 the essentially rectangular member 87 protrudes radially from the peripheral surface 77 of the marking wheel 73 so that as the wheel is rotated a mark may be placed on the work member.

The essentially columnar member has a reservoir for fluid ink for supplying ink to the rectangular member 87. Preferably, the columnar member contains an absorbent material such as, for example, cotton fibers or the like that absorb and retain the fluid ink.

The marking element 87 in FIGS. 10–12 conforms to the configuration of the marking element recess 81 and is capable of being inserted into the recess and removed when desired. The marking element 87 is retained in the marking element recess 81 by friction so that as the wheel is rotated the marking element remains in the recess.

The embodiment in FIGS. 7–12 also has a movable guide 95 that is similarly fastened to the extended arm 75 as the device illustrated in FIGS. 1–4.

As an additional feature of the invention a cap (not illustrated) may be placed over the rectangular portion of the marking element 87 when the wheel is not in use.

In FIG. 8 there is also illustrated an index 93 around the periphery of the wheel on its face comprising numerals at spaced apart intervals, and as illustrated in FIG. 8 at one inch intervals. This feature of the marking wheel permits it to be used accurately to align the marking element of the device with the appropriate starting point of the workpiece to be marked.

Thus, the marking device of my invention has great versatility in use in the building industry and is device of great simplicity and of greater utility than the devices heretofore known. It may be used to mark base and top plates, sheeting, gutters, studs and the like and depending on the workpiece the movable guide may be used.

What is claimed is:

1. A marking device comprising:

a. a cylindrical housing having an outer peripheral surface having a predetermined circumference and two substantially spaced apart parallel faces;

b. at least one recess being formed in said peripheral surface that extends radially inwardly of said cylindrical housing; said recess beginning from said one face of said cylindrical housing and terminating at about one-fourth inch of the other face of said cylindrical housing; said recess forming a first slot on the said one face of said cylindrical housing that has a substantially trapezoidal cross section configuration with a broader base thereof facing radially inwardly of such cylindrical housing and forming a second slot on said peripheral surface of said cylindrical housing that has a substantially rectangular cross-sectional configuration;

c. a marking element extending into said recess and protruding radially outwardly through said second slot; said marking element substantially filling said recess and forming a solid trapezoid, having a trapezoidal cross-sectional configuration that substantially fills the cross sectional configuration of said first slot so that said marking element may be moved axially but not radially from said cylindrical housing; said marking element being composed of a firm, absorbent material;

d. an ink supply source within said housing cooperating with said marking element for supplying ink to said marking element; said ink supply source being composed of an absorbent material;

e. an extended arm being journalled to said cylindrical housing; said extended arm comprising a first portion that is journalled to said cylindrical housing and that is spaced apart from and substantially parallel to said cylindrical housing and its line of travel, and a second portion that is inclined to said first portion and extending away from said cylindrical housing and its line of travel;

f. a movable guide being removably secured to said first portion of said arm and being capable of radial extensions beyond the peripheral surface of said cylindrical housing so that said device may be guided along the edge of a workpiece and being capable of radial retraction from extension beyond the said peripheral surface of said cylindrical housing so that said device may be used on a planar surface without interference; and, g. an attachment brush being fixed to said first portion of said extended arm adjacent to said peripheral surface and in contact therewith so that said brush cleans the peripheral surface and said marking element of debris.

2. The marking device of claim 1 wherein said circumference corresponds to a standard linear distance in the building industry.

3. The marking device of claim 1 having indexing means affixed to at least one face of said cylindrical housing; said indexing means having numerals placed thereon at spaced intervals.

4. A marking device comprising:

a. a cylindrical housing having an outer peripheral surface having a predetermined circumference and two substantially spaced apart parallel faces;

b. at least one recess being formed in said peripheral surface that extends radially inwardly of said cylindrical housing; said recess having a first and second portion; said first portion beginning at one face of said cylindrical housing and terminating at the other face of said housing; said recess forming a first slot on the one face and a similar second slot on the other face of said cylindrical housing; each slot having a substantially rectangular cross-sectional configuration and forming a third slot on the peripheral surface of said cylindrical housing that has a substantially rectangular cross-sectional configuration; and said second portion beginning from said first portion having a substantially circular cross-section configuration that extends radially inwardly of said cylindrical housing;

c. a marking element into said recess and substantially filling the same, protruding radially outwardly through said third slot; said marking element being composed of a firm, absorbent material;

d. an ink supply source within said housing cooperating with said marking element for supplying ink to said marking element that substantially fills said second portion of said recess;

e. an extended arm being journalled to said cylindrical housing; said extended arm comprising a first portion that is journalled to said cylindrical housing and that is spaced apart from and substantially parallel to said cylindrical housing in its line of travel, and a second portion that is inclined to said first portion and extending away from said cylindrical housing and its line of travel;

f. a movable guide being removably secured to said first portion of said arm and being capable of radial extensions beyond the peripheral surface of such cylindrical surface so that said device may be guided along the edge of a workpiece and being capable of radial retraction from extension beyond the peripheral surface of said housing so that said device may be used on a planar surface without interference; and, g. an attachment brush being fixed to said first portion of said extended arm adjacent to a peripheral surface and in contact therewith so that said brush cleans the peripheral surface and cylindrical housing of said marking element of debris.

5. The marking device of claim 4 wherein the diameter of said second portion exceeds the width of said first portion.

6. The marking device of claim 4 wherein said marking element and said ink supply source are unitary.

7. The marking device of claim 4 having indexing means affixed to at least one face of said cylindrical housing; said indexing means having numerals placed thereon at spaced intervals.

8. The marking device of claim 4 wherein said circumference corresponds to the standard linear distance in the building industry.

* * * * *